US006606065B1

(12) United States Patent
Payne et al.

(10) Patent No.: US 6,606,065 B1
(45) Date of Patent: Aug. 12, 2003

(54) RF ANTENNA WITH UNITARY GROUND PLANE AND SURFACE MOUNTING STRUCTURE

(75) Inventors: Robert K. Payne, Waseca, MN (US); Wayne A. Lien, Waseca, MN (US)

(73) Assignee: Itron, Inc., Spokane, WA (US)

( * ) Notice: Subject to any disclaimer, the term of this patent is extended or adjusted under 35 U.S.C. 154(b) by 0 days.

(21) Appl. No.: 10/054,750

(22) Filed: Jan. 22, 2002

(51) Int. Cl.[7] ..... H01Q 1/32

(52) U.S. Cl. ..... 343/715; 343/815; 343/848; 343/872

(58) Field of Search ..... 343/715, 815, 343/817, 846, 848, 872, 873

(56) References Cited

U.S. PATENT DOCUMENTS

| | | | | | |
|---|---|---|---|---|---|
| 3,611,399 | A | * | 10/1971 | Rocke | 343/794 |
| 4,864,320 | A | * | 9/1989 | Munson et al. | 343/833 |
| 5,495,261 | A | * | 2/1996 | Baker et al. | 343/846 |
| 5,532,707 | A | | 7/1996 | Klinger et al. | 343/793 |
| 5,936,590 | A | * | 8/1999 | Funder | 343/795 |
| 6,037,912 | A | | 3/2000 | DeMarre | 343/815 |
| 6,049,314 | A | | 4/2000 | Munson et al. | 343/846 |
| 6,069,590 | A | * | 5/2000 | Thompson et al. | 343/795 |
| 6,133,883 | A | | 10/2000 | Munson et al. | 343/700 MS |
| 6,246,368 | B1 | | 6/2001 | Deming et al. | 343/700 MS |

* cited by examiner

*Primary Examiner*—Don Wong
*Assistant Examiner*—Shih-Chao Chen
(74) *Attorney, Agent, or Firm*—Patterson, Thuente, Skaar & Christensen, P..A.

(57) ABSTRACT

A radio frequency (RF) antenna of the present invention generally comprises an electrical conductor and a unitary metallic surface mounting structure. The electrical conductor, which performs the radiator function, is secured to the surface mounting structure so that the electrical conductor may use the surface mounting structure not only as a surface mount but additionally as a ground plane. The surface mounting structure is presented in a cross-configuration having outward extending arms. The arms perform the ground plane function and are bent to a desired angle to produce a desired radiation pattern and/or impedance. A plastic radome with a metallic insert is preferably used to cover the electrical conductor and to secure the electrical conductor to the surface mounting structure.

26 Claims, 3 Drawing Sheets

| ROTATION (DEGREES) | RAW LEVEL (dBm) | FINAL LEVEL (dBuV/m) |
|---|---|---|
| 0 | -27.42 | 154.8 |
| 10 | -27.32 | 154.9 |
| 20 | -27.18 | 155.1 |
| 30 | -27.51 | 154.8 |
| 40 | -27.75 | 154.5 |
| 50 | -28.10 | 154.2 |
| 60 | -28.20 | 154.1 |
| 70 | -27.87 | 154.4 |
| 80 | -27.92 | 154.3 |
| 90 | -28.01 | 154.3 |
| 100 | -27.80 | 154.5 |
| 110 | -27.35 | 154.9 |
| 120 | -27.07 | 155.2 |
| 130 | -26.64 | 155.6 |
| 140 | -26.76 | 155.5 |
| 150 | -26.66 | 155.6 |
| 160 | -26.73 | 155.5 |
| 170 | -26.50 | 155.8 |
| 180 | -26.34 | 155.9 |
| 190 | -26.29 | 156.0 |
| 200 | -26.59 | 155.7 |
| 210 | -26.78 | 155.5 |
| 220 | -26.87 | 155.4 |
| 230 | -27.16 | 155.1 |
| 240 | -27.21 | 155.1 |
| 250 | -28.08 | 154.2 |
| 260 | -28.40 | 153.9 |
| 270 | -28.85 | 153.4 |
| 280 | -29.12 | 153.1 |
| 290 | -29.03 | 153.2 |
| 300 | -28.59 | 153.7 |
| 310 | -28.43 | 153.8 |
| 320 | -28.52 | 153.7 |
| 330 | -28.22 | 154.0 |
| 340 | -27.71 | 154.6 |
| 350 | -27.46 | 154.8 |
| 360 | -27.39 | 154.9 |

ANTENNA RADIATION PATTERN

TEST FREQUENCY (MHz) = 1425
ANTENNA CORRECTION FACTOR (dB) = 28.15
COAX LOSS (dB) = 2.20
ELEVATION TO ANT. CENTER (cm) = 209.5

RF ANTENNA WITH UNITARY GROUND PLANE AND SURFACE MOUNTING STRUCTURE

FIELD OF THE INVENTION

The present invention relates to radio frequency (RF) antennas and, more particularly to an RF antenna that employs a unitary, metallic, surface mounting structure that additionally serves as the ground plane for the antenna.

BACKGROUND OF THE INVENTION

In RF communication systems and, specifically, utility meter fixed network systems, the RF antenna that transmits the utility consumption data is most often integral to the utility meter transceiver. The utility meter transceiver is, in turn, most often integral to the utility meter box. Thus, when mounting the utility meter box, or when mounting other system RF devices that transmit data via an integral antenna, it is possible for the integral antenna to be shielded by terrain features or structures, e.g., buildings, subway tunnels, etc., such that propagation from the RF antenna is not acceptable and the utility meter data is not obtainable.

One solution to this problem is to provide a different technology mix of meters and transceivers suitable to the shielded location. However, the use of such a technology mix usually results in added installation cost and added complexity to the overall RF system.

SUMMARY OF THE INVENTION

A radio frequency (RF) antenna of the present invention generally comprises an electrical conductor and a unitary, metallic, surface mounting structure. The electrical conductor, the antenna's radiating element, is secured to the metallic surface mounting structure so that the electrical conductor may use the metallic surface mounting structure not only as a surface mount but additionally as a ground plane. The metallic surface mounting structure is presented in a cross-configuration having outward extending arms (radials). The arms perform the ground plane function and are bent to a desired angle to produce a desired radiation pattern and/or impedance. A plastic radome with a metallic insert is preferably used to cover the electrical conductor and to secure the electrical conductor to the surface mounting structure.

A method of assembling the radio frequency antenna of the present invention generally comprises the steps of forming a unitary, surface mounting structure from a metallic material, the formed surface mounting structure having a number of extending arms that are bent to a desired angle, and securing an electrical conductor to the surface mounting structure.

DETAILED DESCRIPTION OF THE PREFERRED EMBODIMENTS

The radio frequency (RF) antenna with unitary ground plane and surface mounting structure of the present invention finds utility in a wide variety of antenna applications, and is especially useful in fixed utility metering systems. Specifically, the RF antenna with unitary ground plane and surface mounting structure of the present invention provides a low-cost, minimal component option in addressing the problem of transmission-shielded transceivers by using off-the-shelf components and inexpensive, easily accessible materials. Rather than reverting to a technology mix of meters and transceivers to overcome antenna propagation that is shielded by terrain or structures, the present invention enables a consumer of an RF meter system to utilize a single technology scheme that ultimately results in reduced installation and maintenance costs.

I. Antenna Elements

Figure 1:
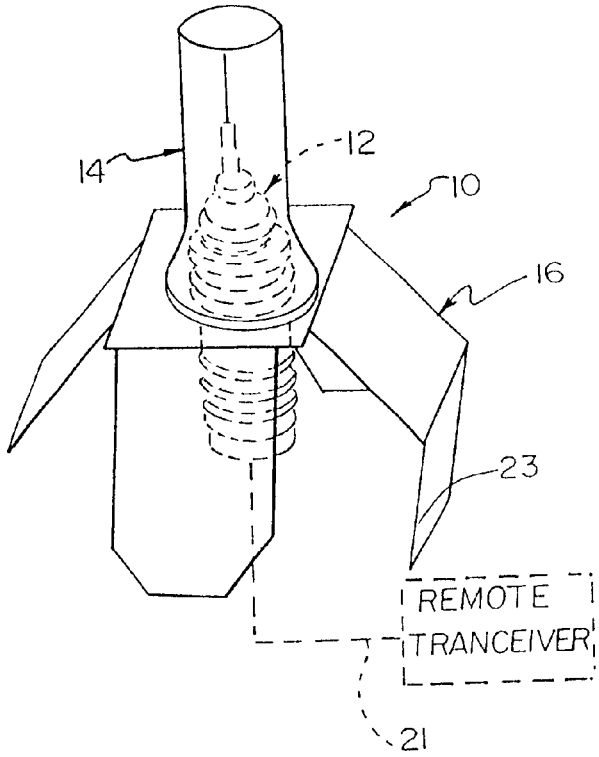
FIG. 1 provides a perspective view of an assembled antenna with unitary ground plane and surface mounting, structure of the present invention.

Referring to FIG. 1, the RF antenna 10 with unitary ground plane and surface mounting structure of the present invention is depicted. The antenna 10 generally comprises a conductive element assembly 12, a radome assembly 14, and the unitary ground plane/surface mounting structure 16.

Figure 2:
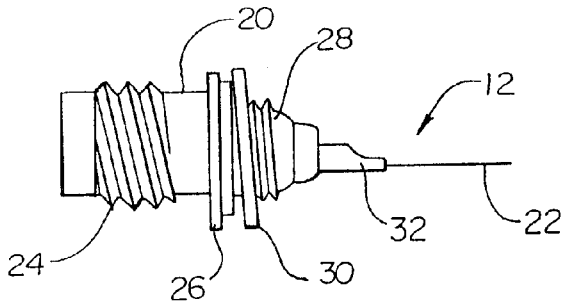
FIG. 2 provides a side view of a conductive element of the antenna of the present invention.

The conductive element assembly 12, see FIG. 2, preferably includes an off-the-shelf (OTS) RF bulkhead connector 20 and a piece of wire conductor 22. In the instance of a quarter-wave antenna, the wire conductor 20 is preferably trimmed to ~¼ wave length. The length of the wire conductor 22 will vary depending on the desired frequency. As shown, the RF bulkhead connector 20 preferably includes a first threaded end 24 that enables the connector 20 to be connected, via cable 21, to a remotely positioned transceiver 23 (cable and transceiver shown in FIG. 1). The RF bulkhead connector further includes a stop plate 26 that contacts the underside of the unitary ground plane/surface mounting structure 16 (described below). A second threaded end 28 of the connector 20 provides a threaded surface to secure the radome assembly 14. A lockwasher 30 is provided to ensure contact between the unitary ground plane/surface mounting structure 16 and the connector 20. The RF bulkhead connector 20 also includes a mounting tip 32 to which the wire conductor 22 is preferably soldered. In a preferred embodiment, the RF bulkhead connector 20 comprises a Pasternack Enterprises PE4063 TNC Female Bulkhead (mat'ls: body—brass nickel plated; contact—gold plated; and insulator—PIFE).

Figure 3:
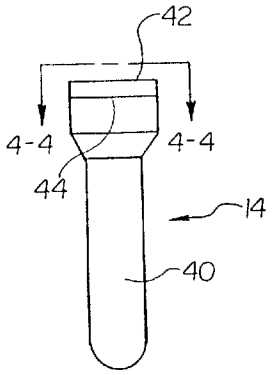
FIG. 3 provides a side view of a radome of the antenna of the present invention.
Figure 4:
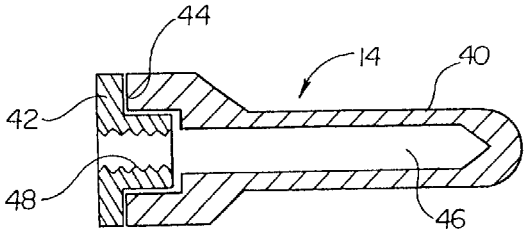
FIG. 4 provides a cross-sectional view of the radome taken along line 4—4 in FIG. 3.

The radome assembly 14, see FIGS. 3 and 4, generally comprises the radome 40 itself and a brass insert 42. The radome 40 is preferably made of a plastic material that is suited for protecting the wire conductor 22 in both interior and exterior environments. In a preferred embodiment, the radome 40 is made from DELRIN® acetal resin, which is a DuPont product. The radome 40 is preferably molded into a configuration such that the distal end 44 is accepting of the brass insert 42 via a press fit, and such that a central cavity 46 is provided to accommodate the RF bulkhead connector 20 and the wire conductor 22 soldered thereto. The brass insert 42 is preferably provided with a threaded inner surface 48 enabling it to be threaded onto the second threaded end 28 of the RF bulkhead connector 20 so as to secure the radome assembly 14 to the connector 20 and the connector 20, via lockwasher 30, to the unitary ground plane/surface mounting structure 16.

Figure 5:
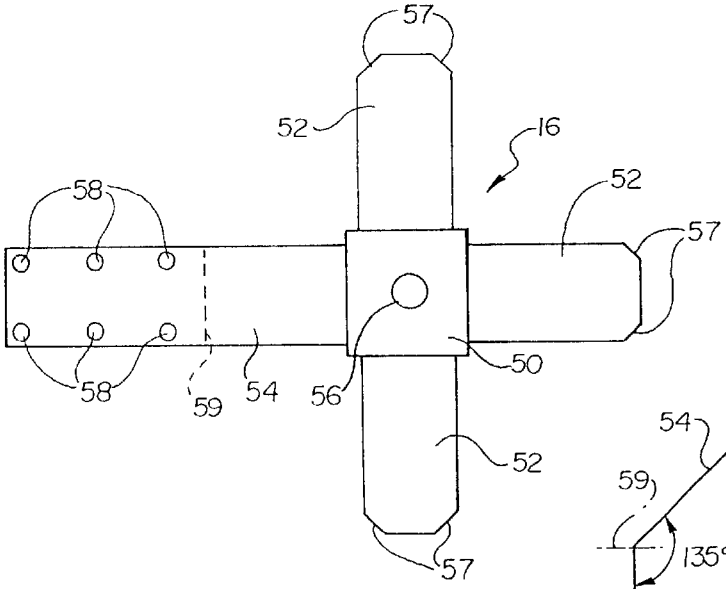
FIG. 5 provides a plan view of an unbent unitary ground plane and surface mounting structure of the antenna of the present invention.
Figure 6:
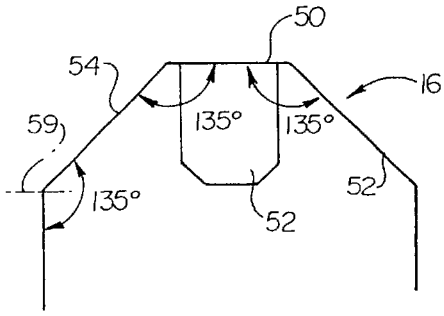
FIG. 6 provides a bending diagram of the unitary ground plane and surface mounting structure of FIG. 6.

The unitary ground plane/surface mounting structure 16 is shown in an unfolded state in FIG. 5, wherein the cross-shaped configuration of the structure 16 is exemplified, and in a folded state in FIG. 6. The unitary ground plane/surface mounting structure 16 incorporates the unitary components of a central connector mounting plate 50, three radial arms 52, and a mounting arm 54. The central connector mounting plate 50 includes an aperture 56 therethrough for the positioning and mounting of the RF bulkhead connector 20. The three radial arms 52, and as well, the mounting arm 54, are of a slightly diminished width from that of the central connector mounting plate 50 (e.g., 1.6 inch width—plate 50 and 1.4 inch width arms 52, 54) to enable easier bending of the arms 52 and 54 relative to the central connector mounting plate 50. Note that the outer comers 57 of each of the radial arms 52 have been chamfered for safety. The mounting arm 54 preferably includes a plurality of mounting apertures 58 through which appropriate fasteners may be inserted to secure the unitary ground plane/surface mounting structure 16 to a surface, e.g., wood, metal, plastic, etc., surface of a structure. In a preferred embodiment, the unitary ground plane/surface mounting structure 16 is stamped, cut, or otherwise formed from a sheet of stainless steel having a thickness of 0.047 inches then bent per antenna design specifications. It should be noted that the bending, or angular adjustment, of the arms 52 and 54 of the unitary ground plane/surface mounting structure 16 is preferably performed during manufacture in accordance with design specifications that have been developed to optimize operation of the RF antenna 10. As such, in the preferred embodiment, the RF antenna 10 is not designed to be field tunable/retunable through further angular adjustment of the arms 52 and 54.

II. Antenna Assembly and Operation

As indicated above, during manufacture of the unitary ground plane/surface mounting structure 16 the three radial arms 52 and the mounting arm 54 are bent downward from the plane defined by the mounting plate 50. Each of the arms 52 and 54 is preferably positioned at the same angle relative to the mounting plate 50, e.g., see FIG. 6, wherein each of the arms 52 and 54 is at an angle of 135 degrees relative to the mounting plate 50. Additionally, the mounting arm 54 is bent yet again along line 59, so as to present the plurality of mounting apertures 58 in an orientation that is substantially perpendicular to the central connector mounting plate 50, allowing the mounting plate 50 to reside in a substantially horizontal orientation when the unitary ground plane/surface mounting structure is secured to a surface.

With the unitary ground plane/surface mounting structure appropriately configured, the RF antenna 10 of the present invention may be assembled by soldering the wire conductor 22 to the mounting tip 32 of the RF bulkhead connector 20 and trimming the wire conductor 22 to the appropriate length to achieve the desired frequency. The second threaded end 28 of the RF bulkhead connector 20 is then inserted through the aperture 56 of the central connector mounting plate 50 of the unitary ground plane/surface mounting structure 16 until the stop plate 26 of the RF bulkhead connector 20 is in contact and flush against the underside of the mounting plate 50. With the conductive element assembly 12 appropriately positioned relative to the unitary ground plane/surface mounting structure 16, the radome assembly 14 is threaded, via the threaded inner surface 48 of the brass insert 42, onto the second threaded end 28 of the RF bulkhead connector 20 until the lockwasher 30 is secured between, and in contact with both, the brass insert 42 and the upperside of the central connector mounting plate 50. With the conductive element assembly 12 secured to the mounting plate 50 via the radome assembly 14 (i.e., continuous metal contact between the conductive element assembly 12, the radome assembly 14, and the structure 16), the mounting plate 50 and surrounding arms 52 and 54 operate as the ground plane for the wire conductor 22.

It should be noted that the impedance and the radiation pattern of the RF antenna 10 can be tuned by changing the bend angle and dimensions of the three radial arms 52 and the mounting arm 54 of the unitary ground plane/surface mounting structure 16. It should further be noted that not only does the unitary ground plane/surface mounting structure 16 enable tuning of the RF antenna 10, it also supplies a platform for physically mounting the RF antenna 10 to a surface whereby the RF antenna 10 is positioned at an appropriate and consistent distance from any mounting surface so as to minimize distortion to the radiation pattern of the RF antenna 10. The ability to position the RF antenna 10 at a consistent distance from a mounting surface also aids in minimizing the affect of different mounting surface materials, e.g., wood, metal, masonry, etc., on the radiation pattern of the RF antenna 10.

Figure 7:
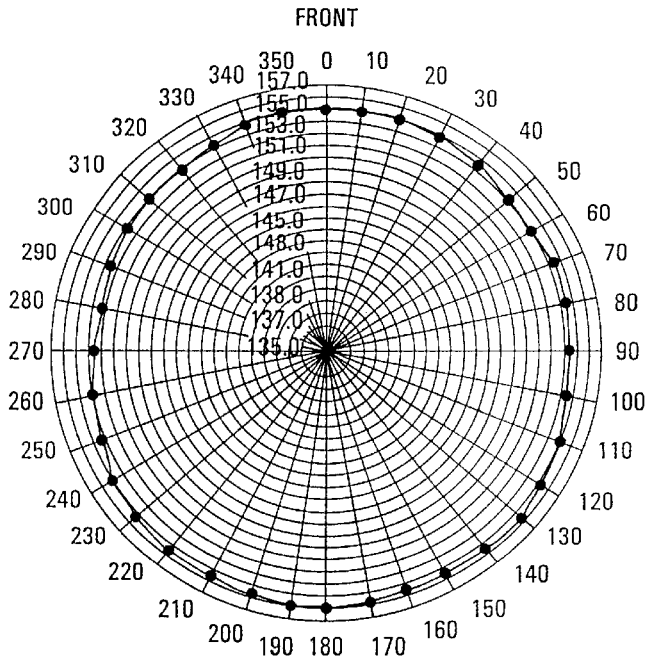
FIG. 7 provides an antenna radiation pattern of an embodiment of the antenna of the present invention.

FIG. 7 depicts the omni-directional radiation pattern of one embodiment of the RF antenna 10. In this embodiment, each of the radial arms 52 and the mounting arm 54 are bent at an angle of 135 degrees relative to the central connector mounting plate 50 (or 45 degrees as measured from a vertical reference). Further, each of the radial arms 52 and that portion of the mounting arm 54 that comprises the radial are 1.4 inches in width and 2.6 inches in length, and are stamped from 0.047 inch stainless steel. The RF bulkhead connector 20 is a PE4063 connector, and the radome assembly 14 described above was provided and covered the antenna element, i.e., wire conductor 22.

The RF antenna 10 may now be mounted in a desired unshielded location and connected, via cable threadably secured to the first threaded end 24 of the RF bulkhead connector 20, to a remote transceiver (e.g., meter box, hub, relay, etc.). The ability to remotely mount the inexpensive, yet high performance, RF antenna 10 of the present invention enables access to hard-to-read meters while maintaining the integrity of the overall metering system.

The present invention may be embodied in other specific forms without departing from the spirit of the essential attributes thereof; therefore, the illustrated embodiments should be considered in all respects as illustrative and not restrictive, reference being made to the appended claims rather than to the foregoing description to indicate the scope of the invention.

What is claimed:

1. A radio frequency antenna assembly, comprising:

an electrical conductor; and a unitary, metallic, surface mounting structure, wherein said electrical conductor is secured to said surface mounting structure, wherein at least a portion of said surface mounting structure functions as a ground plane for said electrical conductor and wherein at least a portion of said surface mounting structure functions as an external surface mount for remote location mounting of said radio frequency antenna assembly.

2. The assembly of claim 1, wherein said surface mounting structure is comprised of stainless steel.

3. The assembly of claim 1, wherein said surface mounting structure has a cross-configuration.

4. The assembly of claim 1, further comprising a radome, said radome covering said electrical conductor.

5. The assembly of claim 4, wherein said radome secures said electrical conductor to said surface mounting structure.

6. The assembly of claim 5, wherein said radome secures via a metallic connector.

7. The assembly of claim 1, wherein said portion of said surface mounting structure that operates as a ground plane is angularly adjusted to a desired angle.

8. The assembly of claim 7, wherein said desired angle affects an antenna operating parameter selected from a group consisting of: a radiation pattern and an impedance.

9. A radio frequency antenna assembly, comprising:

an electrical conductor; and a unitary, surface mounting structure, wherein said electrical conductor is secured to said surface mounting structure, and wherein said surface mounting structure has a cross-configuration with a plurality of extending arms and wherein at least one of said plurality of extending arms is an external surface mount enabling remote location mounting of said radio frequency antenna assembly.

10. The assembly of claim 9, wherein said plurality of extending arms operates as a radio frequency radiator for said electrical conductor.

11. The assembly of claim 9, wherein at least one of said plurality of extending arms is adjusted to a desired angle.

12. The assembly of claim 11, wherein said desired angle affects an operating parameter of said radio frequency antenna assembly, said operating parameter selected from a group consisting of: a radiation pattern and an impedance.

13. The assembly of claim 9, wherein said surface mounting structure is comprised of stainless steel.

14. The assembly of claim 9, further comprising a radome, said radome covering said electrical conductor.

15. The assembly of claim 14, wherein said radome incorporates a metal connector, and wherein said metal connector secures said electrical conductor to said surface mounting structure.

16. The assembly of claim 9, wherein said surface mounting structure functions as a ground plane for said electrical conductor.

17. A radio frequency antenna, comprising:

conducive means for transmitting electromagnetic energy; and surface mounting means for supporting said conductive means, for mounting said radio frequency antenna to a remotely located surface, and for operating as a ground plane to said conductive means.

18. The antenna of claim 17, wherein said surface mounting means comprises a unitary structure.

19. The antenna of claim 18, wherein said unitary structure has a cross-configuration.

20. The antenna of claim 17, further comprising cover means for covering said conductive means and for securing said conductive means to said surface mounting means.

21. The antenna of claim 17, wherein said surface mounting means additionally for affecting an operating parameter of the antenna, said operating parameter selected from a group consisting of: a radiation pattern and an impedance.

22. A method of assembling a radio frequency antenna, comprising the steps of:

forming a unitary surface mounting structure from a metallic material, the formed unitary surface mounting structure having a plurality of radials;

bending each of said plurality of radials to a desired angle; and securing an electrical conductor to said unitary surface mounting structure.

23. The method of claim 22, wherein said step of securing said electrical conductor is performed with a radome.

24. The method of claim 22, wherein upon securing said electrical conductor to said unitary surface mounting structure said unitary surface mounting structure functions as a ground plane to said electrical conductor.

25. The method of claim 22, further comprising the step of mounting said surface mounting structure to a surface.

26. The method of claim 22, further comprising the step of connecting said electrical conductor to a remotely positioned radio frequency transceiver.

* * * * *